US009809905B2

(12) United States Patent
Endo et al.

(10) Patent No.: US 9,809,905 B2
(45) Date of Patent: Nov. 7, 2017

(54) AMORPHOUS POLYETHERIMIDE FIBER AND HEAT-RESISTANT FABRIC

(75) Inventors: Ryokei Endo, Tokyo (JP); Yosuke Washitake, Kurashiki (JP); Yukie Hashimoto, Tokyo (JP); Akihiro Uehata, Kurashiki (JP)

(73) Assignee: KURARAY CO., LTD., Kurashiki-shi (JP)

( * ) Notice: Subject to any disclaimer, the term of this patent is extended or adjusted under 35 U.S.C. 154(b) by 502 days.

(21) Appl. No.: 13/234,561

(22) Filed: Sep. 16, 2011

(65) Prior Publication Data

US 2012/0015184 A1 Jan. 19, 2012

Related U.S. Application Data

(63) Continuation of application No. PCT/JP2010/051709, filed on Feb. 5, 2010.

(30) Foreign Application Priority Data

Mar. 26, 2009 (JP) ..... 2009-075732

(51) Int. Cl.

| | |
|---|---|
| ***D02G 3/00*** | (2006.01) |
| ***D02G 1/00*** | (2006.01) |
| ***D01D 5/08*** | (2006.01) |
| ***D01F 6/74*** | (2006.01) |
| ***D01F 6/66*** | (2006.01) |

(52) U.S. Cl.
CPC ..... *D01D 5/08* (2013.01); *D01F 6/66* (2013.01); *D01F 6/74* (2013.01); *D10B 2331/06* (2013.01); *Y10T 428/2913* (2015.01)

(58) Field of Classification Search
USPC ..... 428/364; 264/610
See application file for complete search history.

(56) References Cited

U.S. PATENT DOCUMENTS

| | | | | |
|---|---|---|---|---|
| 4,943,481 | A | 7/1990 | Schilo et al. | |
| 5,962,608 | A * | 10/1999 | Ryang et al. | 526/89 |
| 2006/0084741 | A1* | 4/2006 | Blackburn et al. | 524/425 |
| 2006/0281840 | A1* | 12/2006 | Gallucci et al. | 524/115 |
| 2008/0006970 | A1* | 1/2008 | Dris et al. | 264/610 |
| 2008/0012170 | A1 | 1/2008 | Lak et al. | |
| 2009/0029615 | A1 | 1/2009 | Susarla et al. | |

FOREIGN PATENT DOCUMENTS

| | | | |
|---|---|---|---|
| CN | 1867592 | A | 11/2006 |
| JP | 59-022726 | | 2/1984 |
| JP | 63-303115 | | 9/1988 |
| JP | 63-275712 | | 11/1988 |
| JP | 1-118614 | * | 5/1989 |
| JP | 01-118614 | | 5/1989 |
| JP | 01-132898 | | 5/1989 |
| JP | 2007-503513 | | 2/2007 |
| JP | 2010-534744 | A | 11/2010 |
| WO | WO 2005/021599 | | 3/2005 |
| WO | 2008/008600 | A2 | 1/2008 |

OTHER PUBLICATIONS

Translation: "Improved Polyether Imide Fiber and method of manufacture thereof", JP-01118614 A , May 11, 1989.*
Office Action issued Jul. 3, 2013 in Chinese Patent Application No. 201080012023.4.
Office Action issued Jan. 22, 2013 in Chinese Patent Application No. 201080012023.4.
U.S. Appl. No. 13/812,697, filed Jan. 28, 2013, Endo, et al.
Supplementary European Search Report issued Oct. 16, 2012, in European Patent Application No. 10755763.9 filed Feb. 5, 2010.
Boehringer , et al., "New Filaments and Fibres of Polyetherimide", Makromol. Chem, Macromol. Symp, vol. 50, pp. 31-39 (1991) XP 000267605.
Office Action issued Sep. 5, 2012, Chinese Patent Application No. 201080012023.4 filed Feb. 5, 2010 (with a partial English translation).
Zhou Xiang Xing, "Engineering Plastics grades and production formula", pp. 320-321, published Jun. 30, 2008 by liu xing (JiangSu, JS, China).
Notification of Intention to Grant and Search Report issued Jan. 24, 2014 in Chinese Patent Application No. 201080012023.4 (with English translation of categories of cited documents).
Notification of Reason(s) for Rejection issued Feb. 25, 2014 in Japanese Patent Application No. 2011-505920 (with partial English language translation).

* cited by examiner

*Primary Examiner* — Jennifer Chriss
*Assistant Examiner* — Ricardo Lopez
(74) *Attorney, Agent, or Firm* — Oblon, McClelland, Maier & Neustadt, L.L.P.

(57) ABSTRACT

Provided are an amorphous polyetherimide fiber having not only a small single fiber fineness suitable for producing fabrics, and a fabric comprising the amorphous polyetherimide fiber. The fiber comprises an amorphous polyetherimide polymer having a molecular weight distribution (Mw/Mn) of less than 2.5, and having a shrinkage percentage under dry heat at 200° C. of 5% or less, and a single fiber fineness of 3.0 dtex or less. The fiber may have a tenacity at room temperature of 2.0 cN/dtex or greater.

17 Claims, No Drawings

AMORPHOUS POLYETHERIMIDE FIBER AND HEAT-RESISTANT FABRIC

CROSS REFERENCE TO THE RELATED APPLICATIONS

This application is a continuation application, under 35 U.S.C. §111(a), of international application No. PCT/JP2010/051709, filed Feb. 5, 2010, which claims priority to Japanese Patent Application No. 2009-075732, filed Mar. 26, 2009, the entire disclosure of which is herein incorporated by reference in their entirety into this application.

FIELD OF THE INVENTION

The present invention relates to an amorphous polyetherimide (hereinafter abbreviated as PEI) fiber having not only a small single fiber fineness suitable for producing papers or nonwoven fabrics from the fiber, but also an excellent heat-resisting property, and to a heat-resistant fabric containing the same. The PEI fibers and heat-resistant fabrics produced therefrom can be used effectively in many applications, such as industrial material fields, electric and electronic fields, agricultural material fields, apparel fields, optical material fields, and aircraft, automobile, and vessel fields, as well as many applications other than above.

BACKGROUND ART

Amorphous PEI polymers are broadly used as super engineering plastics, as film materials, or as injection-molding materials in various fields, such as electrical and electronic component fields, and automobile part fields, because they are excellent in physical property, fire retardancy, heat-resisting property, mechanical property, insulation, and melt processability.

For example, Patent Document 1 discloses a PEI film obtained by stretching PEI at a sufficiently lower temperature than the glass transition temperature of the PEI, and describes that the obtained PEI film is excellent in initial modulus and breaking strength.

In general, it is difficult to form fibers from amorphous PEI polymers. Amorphous molecules randomly existing in the amorphous PEI polymer make it difficult to form an oriented structure generally required for fibers. Therefore, even if an amorphous PEI polymer is subjected to form fibers therefrom, such obtained fibers generally hardly satisfy the quality for practical use. In fact, although Patent Document 1 exemplifies a yarn as an embodiment of molded article, Patent Document 1 does not actually produce yarn in any of the Examples.

Accordingly, Patent Document 2 proposes a method for producing a PEI fiber by drawing an as-spun PEI yarn without using oil solution, the as-spun PEI yarn being obtained by melt spinning method. Patent Document 2 describes that the tenacity of thus obtained PEI fiber can be improved by the above-mentioned drawing method.

Moreover, when melt spinning of amorphous PEI polymer, the temperature required for the melt spinning method is almost 400° C., which is close to the decomposition temperature of the polymer. Therefore, the method has the problem that volatile component is easy to generate from the polymer in the melt spinning process. In view of this, a method for producing of an amorphous PEI fiber comprising melt spinning of an amorphous PEI polymer is also proposed. In the method the water content of the polymer is controlled in the extruder or a volatile component is deaerated from the extruder in order to accomplish PEI fiber formation by using melt spinning method (see, for example, Patent Document 3).

PATENT DOCUMENT

[Patent Document 1] JP Laid-open Patent Publication No. 59-022726

[Patent Document 2] JP Laid-open Patent Publication No. 63-275712

[Patent Document 1] JP Laid-open Patent Publication No. 63-303115

DISCLOSURE OF THE INVENTION

Problems to be Resolved by the Invention

As mentioned above, amorphous PEI polymers are not good material for forming fibers. Further, even if fibers were obtained from amorphous PEI polymer, it was impossible to obtain amorphous PEI fibers having a small fineness. For example, the single fiber finenesses of the fibers obtained in Patent Documents 2 and 3 are about 30 dtex and 450 dtex, respectively.

On the other hand, there is a high need for amorphous PEI fibers having a small fineness in the fields of heat-resistant insulating papers and the heat-resistant clothing materials which are assumed to be the main applications of amorphous PEI fibers. Accordingly, these problems are fatal to accomplish the above needs.

Moreover, as is performed in Patent Documents 2 and 3, it is a widely known technique to draw fibers so as to obtain a fiber having a small fineness and high tenacity. It is true that the tenacity of the drawn fiber is improved at room temperature because the molecule orientation is maintained at room temperature at which molecular mobility of the PEI fiber is low.

However, in the conventionally performed methods, the obtained PEI fiber could not attain the heat-resisting property required for real use. This is clearly shown, for example, in Patent Document 3 describing that the fiber obtained in Patent Document 3 has a boiling contraction of 7% or greater.

The object of the present invention is to provide an amorphous PEI fiber not only having a small single fiber fineness, but also attaining excellent heat resistance, and to provide a heat-resistant fabric using the same.

Moreover, another object of the present invention is to provide an amorphous PEI fiber, while the fiber having a greater mechanical property than conventional PEI fibers, the fiber also achieving heat-resisting property, fire retardancy, dye affinity, low smoke emission, and others, and the fiber further having a small single fiber fineness suitably applicable for papers and/or nonwoven fabrics; and to provide a heat-resistant fabric using the above fiber.

Means of Solving the Problems

As a result of intensive studies conducted by the inventors of the present invention to obtain an above-mentioned amorphous PEI fiber, it has been finally found that (i) drawing treatment or drawing and subsequently heating treatment of amorphous molecules in the amorphous PEI polymer never generates orientation nor crystallization of the molecules, resulting in making fully-extended molecules unstable, and that (ii) such molecules generate entropy shrinkage at high temperatures over 100° C. because of gradual increase in molecule movement, resulting in further shrinkage at a temperature of 200° C. which is close to the glass transition temperature of the polymer.

Further, the inventors have continued intensive studies for improvement and have found that it is necessary to control the characteristics of amorphous PEI polymer from the viewpoint of fiber forming in order to form amorphous PEI fibers in a stable manner, and that an amorphous PEI fiber having a small single fiber fineness as well as a slight shrinkage at high temperatures, which was unobtainable in the conventional manner, can be produced by controlling polymer characteristics of an amorphous PEI polymer to have an specific molecular weight distribution and by spinning such an amorphous PEI polymer in the specific spinning manner.

That is, the present invention provides an amorphous polyetherimide fiber comprising an amorphous polyetherimide polymer having a molecular weight distribution (Mw/Mn) of less than 2.5, and having a shrinkage percentage under dry heat at 200° C. of 5% or less, and a single fiber fineness of 3.0 dtex or less.

As another embodiment, the present invention may be preferably an amorphous polyetherimide fiber of the above type having a tenacity at room temperature of 2.0 cN/dtex or greater, or may be an undrawn as-spun yarn.

Further, the present invention includes a heat resistant fabric comprising the amorphous polyetherimide fiber. Such a fabric may have a shrinkage percentage under dry heat at 200° C. of 5.0% or less.

Effect of the Invention

According to the present invention, it is possible to provide amorphous PEI fibers combining a small fineness and a heat-resisting property, and being suitably applicable to heat-resistant fabrics and others.

Moreover, the amorphous PEI fiber with a specific tenacity has an excellent mechanical property, a heat-resisting property, fire retardancy, dye affinity, low smoke emission, and others. Further, according to the present invention, it is possible to provide an amorphous PEI fiber having a small single fiber fineness and being suitably applicable to fabrics, such as papers, woven fabrics, knitted fabrics and nonwoven fabrics.

The heat-resistant fabric including such amorphous PEI fibers has flexibility originated from the fiber property, while achieving an improved heat-resisting property as well as fire retardancy.

DESCRIPTION OF THE EMBODIMENTS (Amorphous PEI Polymer)

Hereinafter, the present invention is described in further detail. The PEI polymer which constitutes the amorphous PEI fiber of the present invention is first described. The amorphous PEI polymer used in the present invention is a polymer comprising an aliphatic, alicyclic, or aromatic ether unit and a cyclic imide as a repeating unit, and is not limited to a specific one as long as the polymer has an amorphous property and melt formability. Moreover, the main chain of the amorphous PEI polymer also comprises a structural unit, such as an aliphatic, alicyclic or aromatic ester unit and an oxycarbonyl unit, other than the cyclic imide and the ether unit within the range that the effect of the present invention is not deteriorated.

More concretely, as the amorphous PEI polymer to be suitably used, there may be mentioned a polymer comprising a unit of the following general formula. It should be noted that in the formula R1 is a divalent aromatic residue having 6 to 30 carbon atoms; R2 is a divalent organic group selected from the group consisting of an aromatic residue having 6 to 30 carbon atoms, an alkylene group having 2 to 20 carbon atoms, a cycloalkylene group having 2 to 20 carbon atoms, and a polydiorganosiloxane group in which a chain is terminated with an alkylene group having 2 to 8 carbon atoms.

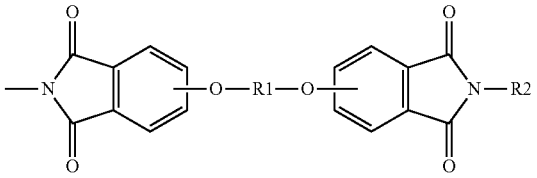

The preferable R1 and R2 include, for example, an aromatic residue and/or an alkylene group (for example, m=2 to 10) shown in the following formulae.

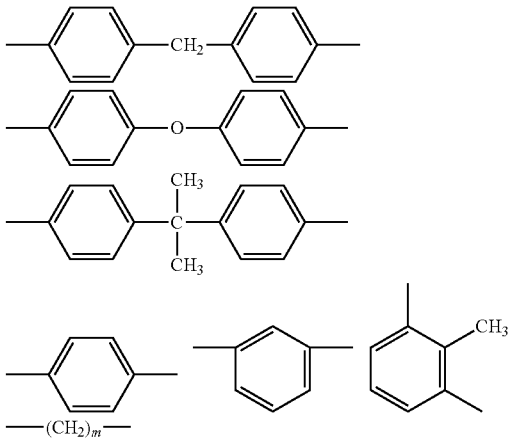

In the present invention, from the viewpoint of an amorphous property, melt formability, and cost reduction, the preferable amorphous PEI polymer includes a condensate of 2,2-bis[4-(2,3-dicarboxyphenoxy)phenyl]propane dianhydride and m-phenylenediamine, having a structural unit shown by the following formula as a main constituent. Such polyetherimide is available from SABIC Innovative Plastics Holding under the trademark of "Ultem".

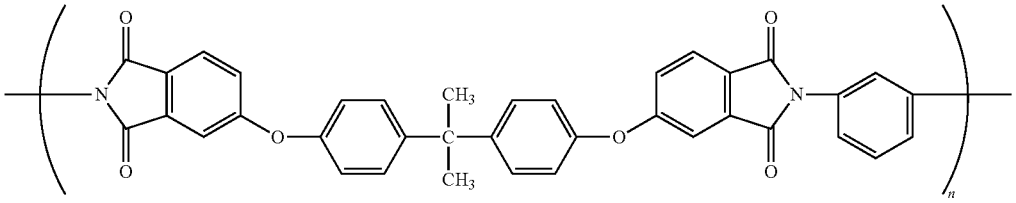

The amorphous PEI polymer used in the present invention may contain a thermal stabilizer, an antioxidant, a radical inhibitor, a delustering agent, an ultraviolet absorption agent, a flame retardant, an inorganic substance, and other polymers within the range that they do not inhibit the effect of the present invention.

In view of improving melt-spinnability of the polymer, the polymer preferably comprises a thermal stabilizer, and examples of the thermal stabilizer include hindered-phenol-type thermal stabilizers, phosphorus thermal stabilizers, lactone-type thermal stabilizers, hydroxylamine-type thermal stabilizers, vitamin-E-type thermal stabilizers, sulfur thermal stabilizers, and the like. Among them, phosphorus thermal stabilizers are more preferable, and especially preferable one includes aryl-phosphite compounds, such as tris(2,4-di-tert-butylphenyl)phosphate.

Moreover, examples of the above-mentioned inorganic substance include carbides, such as carbon nanotubes, fullerenes, carbon blacks, and graphites; silicates, such as talcs, wollastonites, zeolites, sericites, micas, kaolins, clays, pyrophyllites, silicas, bentonites and alumina silicates; metallic oxides, such as silicon oxides, magnesium oxides, aluminas, zirconium oxides, titanium oxides, and iron oxides; carbonates such as calcium carbonates, magnesium carbonates and dolomites; sulfates such as calcium sulfates and barium sulfates; hydroxides, such as calcium hydroxides, magnesium hydroxides and aluminum hydroxides; glass beads, glass flakes, glass powders, ceramic beads, boron nitrides, silicon carbides, carbon blacks and silicas, graphites, and others. Among these inorganic substances, from the viewpoint of raising processability, the preferable one includes metallic oxides and the like, and especially titanium oxides.

Moreover, concrete examples of the above-mentioned polymer to be added may include polyamides, polybutylene terephthalates, polyethylene terephthalates, modified polyphenylene ethers, polysulfones, polyether sulfones, polyarylsulfones, polyketones, polyarylates, liquid crystal polymers, polyetherketones, polythioetherketones, polyetheretherketones, polyimides, polyamideimides, polytetrafluoroethylenes, polycarbonates, and others.

The molecular weight of the amorphous PEI polymer used in the present invention is not limited to a specific one. In taking the mechanical property, dimensional stability, and processability of the fibers formed from the polymer into consideration, the amorphous PEI polymer preferably has a melt viscosity of 5,000 poise or lower measured at the temperature of 390° C. and the shear rate of 1,200 $sec^{-1}$, and in view of this, the amorphous PEI polymer preferably has a weight-average molecular weight (Mw) of about 1,000 to about 80,000. Although it is desirable to use a polymer having a large molecular weight because such polymer is excellent in heat-resisting property as well as capable of forming fibers with an improved tenacity, a polymer preferably has an Mw of 10,000 to 50,000 in view of cost required for polymer production and/or fiber forming.

The amorphous PEI polymer used in the present invention should have a molecular weight distribution (Mw/Mn) of less than 2.5, which is the ratio of a weight-average molecular weight (Mw) and a number-average molecular weight (Mn). The polymer having a molecular weight distribution of larger than the above should deteriorate in processability because of a large quantity of volatile component emitted therefrom as well as unevenness of discharge amount from the nozzles, resulting in unsuccessful spinning for forming fibers having a small single fiber fineness, and unstable production of fibers excellent in heat-resisting property.

Since the polymer having a molecular weight distribution of 1 is a polymer having the ideal mono-disperse structure, the molecular weight distribution of the polymer is preferably within the range between 1.0 and 2.4, and more preferably within the range between 1.0 and 2.3. The polymer having such a small molecular weight distribution can be produced by the method, for example, described in the JP Laid-open Patent Publication No. 2007-503513, but the method is not limited to the above. In addition, as mentioned later in detail, the weight-average molecular weight (Mw), the number-average molecular weight (Mn), and the molecular weight distribution can be determined, for example, as the molecular weight of polystyrene by gel permeation chromatography (GPC) which is a kind of a size exclusion chromatography (SEC).

(Amorphous PEI Fiber)

The amorphous PEI fiber of the present invention needs to retain a heat-resisting property under high temperatures such as 200° C. even if the fiber has a small fineness. Such a heat-resisting property can be determined by the shrinkage percentage under dry heat at 200° C., and the amorphous PEI fiber of the present invention has a shrinkage percentage under dry heat at 200° C. of 5.0% or less, and, more specifically of −1.0% to 5.0%.

If the shrinkage percentage of the polymer under dry heat exceeds 5.0%, the polymer is determined to have an insufficient heat-resisting property, resulting in enlargement of dimensional change of the product at the time of processing and/or usage. In contrast, the polymer having a shrinkage percentage under dry heat of less than −1.0% may not be desirable in the same reason as above. The polymer preferably has a shrinkage percentage under dry heat of −1.0% to 4.5%, more preferably of 0% to 4.0%. It should be noted that the shrinkage percentage under dry heat here means the value measured by the method described later. Moreover, the polymer preferably shows the heat-resisting property at temperatures within the range between 100° C. and 200° C., and in view of this, the polymer may have a shrinkage percentage under dry heat described above at each temperature within the range between 100° C. and 200° C.

Further, the amorphous PEI fiber of the present invention has an improved fire retardancy due to the polymer nature, and the fiber may have, for example, a limiting oxygen index value (LOI value) of 25 or greater, preferably of 28 or greater, and more preferably of 30 or greater. Although it is desirable for fibers to have an LOI value as high as possible, the LOI value is 40 or less in many cases. It should be noted that the LOI value here is a value measured by the method in Examples described below.

Furthermore, the amorphous PEI fiber of the present invention requires having a single fiber fineness of 3.0 dtex or less. If the single fiber fineness of the fiber exceeds 3.0 dtex, such fiber cannot be determined to have a small fineness, and the application of such fiber in real use will be limited. In view of manufacturing cost and handling ability, the amorphous PEI fiber preferably has a single fiber fineness of 0.1 to 2.6 dtex, and more preferably of 0.1 to 2.3 dtex.

Furthermore, the amorphous PEI fiber of the present invention preferably has a tenacity at room temperature of 2.0 cN/dtex or greater. When the amorphous PEI fiber has a tenacity of less than 2.0 cN/dtex, such fiber may not be desirable because it is deteriorated in processability for making fabrics, such as papers, nonwoven fabrics and textiles, or may have a limited use application. The amorphous PEI fiber preferably has a tenacity of 2.3 to 4.0 cN/dtex, and more preferably of 2.5 to 4.0 cN/dtex. It should be noted that the tenacity is a value measured by the method in Examples described below.

(Method for Producing Amorphous PEI Fiber)

Specifically, the amorphous PEI fiber of the present invention can be manufactured by a melt spinning method using a melt spinning apparatus, as described below. That is, the method for producing amorphous PEI fibers comprises melt kneading an amorphous PEI polymer to obtain the molten polymer having a predetermined melt viscosity, discharging the above-mentioned molten polymer in a predetermined amount from a spinning nozzle, and winding the discharged yarn (or as-spun yarn) at a predetermined winding rate (or spinning rate).

More specifically, well-known melt-spinning apparatuses can be used for producing the PEI fibers of the present invention. For example, pellets of an amorphous PEI polymer are melt kneaded by using a melt extruder to obtain the polymer having a predetermined melt viscosity, and then the molten polymer is fed to a spinning tube. The molten polymer is metered by a gear pump to discharge a predetermined amount from the spinning nozzle, and the discharged yarn is wound up to produce a PEI fiber of the present invention. It should be noted that since the yarn wound up after melt spinning already has a desired small fineness, the as-spun yarn can be directly used without drawing.

In the present invention, the term "drawing" means a process in which a yarn once wound up after melt spinning is drawn with the use of tension members, such as rollers, and the term "drawing" does not include a process in which as-spun yarn discharged from spinning nozzle is extended when winding.

If needed, the amorphous PEI polymer is preferably subjected to vacuum drying or other drying step prior to melt kneading in order to adjust the moisture content of the polymer. The drying conditions for the amorphous PEI polymer can be suitably selected according to the polymer grade or others, and the temperature for drying the polymer may be, for example, within the range between about 110° C. and about 200° C., preferably within the range between about 110° C. and about 200° C. Moreover, the time required for drying can be suitably selected depending on the amount of polymer, or others, and the drying time may be, for example, from about 5 to 25 hours, preferably about 8 to 16 hours.

The melt viscosity of the molten amorphous PEI polymer under melt kneading may be 1,000 to 5,000 poise, and preferably 1,500 to 4,000 poise measured at a temperature of 390° C. and a shear rate of 1,200 $sec^{-1}$.

Moreover, the hole size (single hole) of the nozzle may be for example, about 0.01 $mm^2$ to about 0.07 $mm^2$, preferably about 0.02 $mm^2$ to 0.06 $mm^2$, and more preferably about 0.03 $mm^2$ to about 0.05 $mm^2$. In addition, the configuration of the hole may be suitably selected according to a required fiber configuration in the cross section.

The amount of the polymer discharged from a spinning nozzle can be suitably selected according to the number of holes in the nozzle or the hole size, and may be, for example, about 35 to 300 g per minute (g/min.), preferably about 40 to 280 g/min.

The winding rate of the discharged yarn (spinning rate) can be suitably decided depending on the hole size of the nozzle, or the discharged amount, from the viewpoint of preventing molecule orientation in the yarn at the spinning, the winding rate may be within a range between 500 m/min. and 4,000 m/min., preferably within a range between 1,000 m/min and 3,500 m/min., and more preferably within a range between 1,500 m/min. and 3,000 m/min.

The winding rate of lower than 500 m/min. may not be desirable from the viewpoint of obtaining a fiber having a small fineness without drawing as much as possible, while the high winding rate of higher than 4,000 m/min. may be also not desirable since such high winding speed may develop molecular orientation leading to shrinkage at a high temperature, and also may cause the fiber breakage easily.

The important point is that the method for producing the amorphous PEI fiber of the present invention is different from the methods described in Patent Documents 2 and 3 in order for the amorphous PEI fibers of the present invention to combine small fineness of the fiber and shrinkage inhibition at a high temperature.

That is, in the conventional spinning methods for producing PEI fiber, the melt spun fiber is drawn at a drawing ratio of about two times to provide the drawn fiber having a small fineness and a tenacity at room temperature. However, such drawing processing at a high ratio may develop the entropy shrinkage resulting from increase in molecule movement under high temperature, and lead to a serious shrinkage of drawn fiber at 200° C. which is close to glass transition temperature of the polymer. Accordingly, such drawn fiber cannot attain the heat-resisting property for real use.

On the other hand, the PEI fiber of the present invention having a small fineness as well as a high heat resistant property can be obtained without drawing or by drawing molten spun yarn discharged from the spinning nozzle as low as possible (for example, draw ratio of about 1.0 to 1.1).

Since the PEI fiber of the present invention excels in processability, the number of fiber breaking times during the spinning and forming fiber process with the use of 100 kg of polymer may be, for example, 5 times or less in many cases, and preferably 3 times or less, and more preferably 2 times or less. Therefore, the amorphous PEI fiber of the present invention can be manufactured with reducing cost.

Since the amorphous PEI fiber of the present invention shows excellent heat-resisting property in any fiber form, such as staple fibers, shortcut fibers, filament yarns, spun yarns, strings, and ropes, it can be used for many applications. Moreover, there is especially no restriction of the configuration of fiber in the cross section, and the cross sectional configuration of the fiber may be circular, hollow, or a variant form such as a star. Furthermore, the amorphous PEI fiber of the present invention having the above-mentioned fiber form may be combined with other fiber(s) if needed.

Further, the present invention also includes a heat-resistant fabric including such amorphous PEI fiber. The type of heat-resistant fabric is not limited to a specific one as long as the fabric comprises the amorphous PEI fiber of the present invention, and the configuration of the fabric includes various types of fabrics, such as nonwoven fabrics, papers, textiles, and knitted fabrics, and others. Such fabrics can be produced from the amorphous PEI fiber by well-known or common methods.

Moreover, the heat-resistant fabric of the present invention comprises fibers having a small fineness, and such fibers, for example, enable to prevent nonwoven fabrics from creating undesirable pores, and to form nonwoven fabrics excellent in appearance. Moreover, such fiber also excels in the processability in paper-making process.

The amorphous PEI fiber according to the present invention has a single fiber fineness of 3.0 dtex or less, while having a low shrinkage percentage under dry heat, and further has fire retardancy, low smoke emission, insulation, and dye affinity which are originated in the polymer nature. Accordingly, the amorphous PEI fiber is advantageously applicable to papers, nonwoven fabrics, clothing materials, and others.

Moreover, at the degree of maintaining of the effect of the present invention, the amorphous PEI fiber may be combined with other type of fiber(s). The heat-resistant fabric comprises an amorphous PEI fiber of the present invention, for example, as subject fiber, and the content of the amorphous PEI fiber in the whole fabric may be 50 mass % or greater, preferably 80 mass % or greater, and especially preferably 90 mass % or greater. By producing the above fabrics (especially papers and nonwoven fabrics), the fabric excellent in the heat-resisting property and the low smoke emission can be obtained.

Since the heat-resistant fabric of the present invention is excellent in the heat-resisting property originating from fiber nature, the shrinkage percentage of the fabric under dry heat at 200° C. may be 5.0% or less (for example, −1.0% to 5.0%), preferably −1.0% to 4.5%, and more preferably 0% to 4.0%. It should be noted that the shrinkage percentage under dry heat is a value measured by the method in Examples described later. Moreover, the fabric preferably shows the heat-resisting property at temperatures within the range between 100° C. and 200° C., and in view of this, the fabric may have a shrinkage percentage under dry heat described above at each temperature within the range between 100° C. and 200° C.

Such heat-resistant fabrics can be effectively used in many applications including, such as industrial material fields, electric and electronic fields, agricultural material fields, apparel fields, optical material fields, and aircraft, automobile, and vessel fields, as well as many applications other than above, and especially useful for insulating papers, working wears, fire fighting uniforms, sheet cushioning materials, hook-and-loop fasteners, and others.

EXAMPLES

Hereinafter, the present invention will be demonstrated by way of some examples that are presented only for the sake of illustration, which are not to be construed as limiting the scope of the present invention. It should be noted that in the following Examples, molecular weight distribution of polymer, tenacity, shrinkage percent under dry heat, limiting oxygen index value, evaluation of fiber forming process were evaluated in the following manners.

[Molecular Weight Distribution (Mw/Mn)]

The molecular weight distribution of each sample was measured by using the gel permeation chromatography (GPC) available from Waters Corporation with 1,500 ALC/GPC (polystyrene conversion). After dissolving each of the samples in chloroform as a solvent to a concentration of 0.2 mass %, the solution was filtered and measured. The molecular weight distribution (Mw/Mn) was calculated from the ratio of the obtained weight-average molecular weight (Mw) based on the number-average molecular weight (Mn).

[Tenacity (cN/dtex)]

The tenacity of each of the samples having a fiber length of 20 cm was measured in accordance with the JIS L1013, in which the preconditioned yarn was measured at the room temperature (25° C.) under the initial load of 0.25 cN/dtex, and tension rate of 50%, and the average of 20 samples (n=20) was adopted. Moreover, the fiber fineness (dtex) of each sample was measured by a mass method.

[Shrinkage Percentage Under Dry Heat (%)]

Fiber samples each in 10 cm length or fabric samples each in 10 cm square were placed for 10 minutes in an air thermostat at a temperature of 200° C. in the state where terminals of the samples were not fixed, and then the lengths of the samples were measured. The shrinkage percentages under dry heat of the samples were calculated in the following formula using the fiber or fabric length (X):

$$\text{Shrinkage percentage under dry heat (\%)} = \langle 10 - X/10 \rangle \times 100$$

[Limiting Oxygen Index Value (LOI Value)]

Samples each tied into a braid and having a length of 18 cm were prepared. According to JIS K7201, after igniting the upper portion of the samples, the minimum oxygen concentration required for the samples to keep burning for at least 3 minutes or alternatively to be burned until the burning length of the sample became at least 5 cm was determined. The average of 3 samples (n=3) was adopted.

[Evaluation of Processability in Forming Fibers]

In the process of spinning and fiber-forming from 100 kg of polymer, the number of fiber breaking times during the process is estimated as follows:

A: 3 times or less/100 kg,

B: 4 to 7 times/100 kg,

C: 8 times or more/100 kg.

Example 1

(1) An amorphous PEI polymer ("ULTEM 9001" produced by SABIC Innovative Plastics Holding) having a weight-average molecular weight (Mw) of 32,000 and a number average molecular weight (Mn) of 14,500 (molecular weight distribution: 2.2) are dried at 150° C. under vacuum for 12 hours.

(2) The polymer obtained in the above (1) was melt kneaded and the molten polymer having a melt viscosity of 2,000 poise measured at a temperature of 390° C. and shear rate of 1,200 $sec^{-1}$ was discharged from the nozzle having round holes, in the condition of the spinning head temperature of 390° C., the spinning rate of 2,000 m/min. and the discharge amount of 50 g/min. to produce multi-filaments having 220 dtex/100 f. The performance evaluation of the obtained fiber is shown in Table 1.

(3) The appearance of the obtained fiber was good and no fluff was observed. The fiber had a single fiber fineness of 2.2 dtex, and both the mechanical property and the heat-resisting property of the fiber were excellent because the fiber had a tenacity of 2.6 cN/dtex, a shrinkage percentage under dry heat at 200° C. of 3.5%, and an LOI value of 31. Moreover, the number of fiber breaking times was 3 times in the spinning test with the use of 100 kg polymer as there was no pressure fluctuation etc., and the spinning stability was determined as good.

Example 2

(1) Except for spinning at a spinning rate of 1,800 m/min. the fiber was obtained in the same way as Example 1. The performance evaluation of the obtained fiber is shown in Table 1.

(2) The appearance of the obtained fiber was good and no fluff was observed. The fiber had a single fiber fineness of 3.0 dtex, and both the mechanical property and the heat-resisting property of the fiber were excellent because the fiber had a tenacity of 2.5 cN/dtex, a shrinkage percentage under dry heat at 200° C. of 3.1%, and an LOI value of 31. Moreover, the number of fiber breaking times was 2 times in the spinning test with the use of 100 kg polymer as there was no pressure fluctuation etc., and the spinning stability was determined as good.

Example 3

(1) An anatase type titanium oxide ("TA-300" produced by Fuji Titanium Industry Co., Ltd.) was added to the polymer in Example 1 (1) in an amount of 40 mass % relative to the polymer, and the mixture was melt kneaded to obtain a master batch. The obtained master batch was mixed to the polymer in Example (1) so as to produce a polymer blend for forming a fiber comprising the anatase type titanium oxide at a concentration of 0.5 mass % relative to the polymer. Except for using the polymer blend, the fiber was obtained in the same way as Example 1. The performance evaluation of the obtained fiber is shown in Table 1.

(2) The appearance of the obtained fiber was good and no fluff was observed. The fiber had a single fiber fineness of 2.2 dtex, and both the mechanical property and the heat-resisting property of the fiber were excellent because the fiber had a tenacity of 2.5 cN/dtex, a shrinkage percentage under dry heat at 200° C. of 2.5%, and an LOI value of 31. Moreover, the number of fiber breaking times was 2 times in the spinning test with the use of 100 kg polymer as there was no pressure fluctuation etc., and the spinning stability was determined as good.

Example 4

(1) Except for using a polymer comprising a phosphorus thermal stabilizer ("Irgafos168" produced by Ciba Specialty Chemicals Corporation) in the concentration of 1 mass % relative to the polymer of Example 1 (1), the fiber was obtained in the same way as Example 1. The performance evaluation of the obtained fiber is shown in Table 1.

(2) The appearance of the obtained fiber was good and no fluff was observed. The fiber had a single fiber fineness of 2.2 dtex, and both the mechanical property and the heat-resisting property of the fiber were excellent because the fiber had a tenacity of 2.6 cN/dtex, a shrinkage percentage under dry heat at 200° C. of 2.7%, and an LOI value of 31. Moreover, the number of fiber breaking times was once in the spinning test with the use of 100 kg polymer as there was no pressure fluctuation etc., and the spinning stability was determined as good.

Example 5

(1) The fiber obtained in Example 1 (1) was cut into short fibers having a length of 3 mm. A wet-laid paper having a weight of 100 g/m$^2$ was produced from 90 mass % of the short fibers and 10 mass % of vinylon fibers ("VPB105" produced by Kuraray Co., Ltd.) as a binder. The heat-resistant evaluation of the obtained paper is shown in Table 1.

(2) There was no pore in the produced paper, and the appearance of the paper was good. The paper was excellent in heat-resisting property as shrinkage percentage under dry heat at 200° C. was 3.0%. Moreover, the fibers also excelled in processability for paper making.

Comparative Example 1

(1) Except for using the amorphous PEI polymer ("ULTEM1000" by the SABIC Innovative Plastics Holding) having a weight-average molecular weight (Mw) of 54,000 and a number average molecular weight (Mn) of 21,000 (molecular weight distribution: 2.6), the spinning method was tried in the same way as Example 1.

(2) However, at the spinning rate of 2,000 m/min., fibers were frequently broken in the spinning and it was unable to obtain fibers having a single fiber fineness of 3.0 dtex or less.

(3) Accordingly, the discharge amount was increased to 120 g/min. so as to obtain fibers at the spinning rate of 2,000 m/min. The evaluation result is shown in Table 2.

(4) The appearance of the obtained fiber was good, and the fiber had a mechanical property of 2.2 cN/dtex and an LOI value of 31. The fiber, however, had a shrinkage percentage under dry heat at 200° C. of 6.0% and a single fiber fineness of 6.0 dtex, and therefore the fiber had neither small fineness nor heat-resisting property. Moreover, the number of fiber breaking times was 5 times in the spinning test with the use of 100 kg polymer as there were some pressure fluctuations.

Comparative Example 2

(1) Except for using the amorphous PEI polymer ("ULTEM1040" by the SABIC Innovative Plastics Holding) having a weight-average molecular weight (Mw) of 34,000 and a number average molecular weight (Mn) of 12,000 (molecular weight distribution: 2.8), the spinning method was tried in the same way as Example 1.

(2) However, at the spinning rate of 2,000 m/min., fibers were frequently broken in the spinning and it was unable to obtain a fiber having a single fiber fineness of 3.0 dtex or less.

(3) Accordingly, the discharge amount was increased to 120 g/min. so as to obtain a fiber at the spinning rate of 2,000 m/min. The evaluation result is shown in Table 2.

(4) The quality of the obtained fiber was not good because the fiber contained bubbles therein, and had fluff and the like. Although the fiber had a mechanical property of 2.0 cN/dtex and an LOI value of 30, the fiber had a shrinkage percentage under dry heat at 200° C. of 9.0% and a single fiber fineness of 5.0 dtex, and therefore the fiber had neither small fineness nor heat-resisting property. Moreover, the number of fiber breaking times was 10 times in the spinning test with the use of 100 kg polymer as there were large pressure fluctuations, and the spinning processability was deteriorated.

Comparative Example 3

(1) Except for using a polymer comprising a phosphorus thermal stabilizer ("Irgafos 168" produced by Ciba Specialty Chemicals Corporation) in the concentration of 1 mass % relative to the polymer of Comparative Example 1 (1), the fiber was obtained in the same way as Comparative Example 1.

(2) However, at the spinning rate of 2,000 m/min., fibers were frequently broken in the spinning and it was unable to obtain fibers having a single fiber fineness of 3.0 dtex or less.

(3) Accordingly, the discharge amount was increased to 120 g/min. so as to obtain fibers at the spinning rate of 2,000 m/min. The evaluation result is shown in Table 2.

(4) The quality of the obtained fibers was not good because the fiber contained bubbles therein, and had fluff and the like. Although the fiber had a mechanical property of 2.4 cN/dtex and an LOI value of 31, the fiber had a shrinkage percentage under dry heat at 200° C. of 5.5% and a single fiber fineness of 6.0 dtex, and therefore the fiber had neither small fineness nor heat-resisting property. Moreover, the number of fiber breaking times was 7 times in the spinning test with the use of 100 kg polymer as there were large pressure fluctuations.

Comparative Example 4

(1) In Comparative Example 1, the spinning rate was lowered to 500 m/min. to obtain fibers. The evaluation result is shown in Table 2.

(2) The appearance of the obtained fiber was good and the fiber had a mechanical property of 2.3 cN/dtex, an LOI value of 31, and a shrinkage percentage under dry heat (200° C.) of 5.0%. The fibers, however, had a single fiber fineness of 6.0 dtex and could not attain a small fineness.

Comparative Example 5

(1) The fiber of Comparative Example 3 having a single fiber fineness of 6.0 dtex was drawn at a draw ratio of 2.0 between rollers set at a temperature of 150° C. for attaining a smaller fineness to obtain a drawn fiber. The evaluation result is shown in Table 2.

(2) The appearance of the obtained fiber was good and the fiber had a tenacity of 2.7 cN/dtex and an LOT value of 31. The fiber, however, had a shrinkage percentage under dry heat (200° C.) of 15.0% and deteriorated in heat resistant property. This deterioration was caused by orientation of amorphous portions by drawing, in other words, the fiber achieved a small fineness by drawing but could not attain a heat resistant property.

Comparative Example 6

(1) The fiber of Comparative Example 3 having a single fiber fineness of 6.0 dtex was drawn at a draw ratio of 1.3 between rollers set at a temperature of 150° C. in order to obtain a fiber having a shrinkage percentage under dry heat (200° C.) of 5.0% or less. The evaluation result is shown in Table 2.

(2) The appearance of the obtained fiber was good and the fiber had a tenacity of 2.6 cN/dtex and an LOT value of 31. The fiber, however, had a single fiber fineness of 4.0 dtex and a shrinkage percentage under dry heat (200° C.) of 8.0%. Therefore, the fiber had neither small fineness nor heat-resisting property.

Comparative Example 7

(1) The fiber obtained in Comparative Example 5 and having a single fiber fineness of 3.0 dtex and shrinkage percentage under dry heat (200° C.) of 15.0% was heat treated under tension to obtain a heat treated fiber. The evaluation result of the obtained fiber is shown in Table 2.

(2) The appearance of the obtained fiber was good and the fiber had a single fiber fineness of 3.0 dtex, a tenacity of 2.2 cN/dtex and an LOI value of 31. The fiber, however, had a shrinkage percentage under dry heat (200° C.) of 13.0%. Therefore, the heat treatment did not contribute to heat-resisting property of the fiber.

Comparative Example 8

(1) The fiber obtained in Comparative Example 4 was cut into short fibers having a length of 3 mm. A wet-laid paper having a weight of 100 g/m$^2$ was produced from 90 mass % of the short fibers and 10 mass % of vinylon fibers ("VPB105" produced by Kuraray Co., Ltd.) as a binder. The heat-resistant evaluation of the obtained paper is shown in Table 2.

(2) Although the paper had a shrinkage percentage under dry heat of 5.0%, there were a lot of pores in the produced paper because of making use of thick fibers having a single fiber fineness of 6.0 dtex, and the appearance of the paper was poor. The obtained paper was not applicable for real use. Further, the processability of the fibers in the paper-making process was also poor.

TABLE 1

| | Amorphous PEI polymer (Mw/Mn) | Single fiber fineness (dtex) | Shrinkage percentage under dry heat (%) | Tenacity (cN/dtex) | Limiting oxygen index value (LOI) | Fiber forming processability | Remark |
|---|---|---|---|---|---|---|---|
| Example 1 | 2.2 | 2.2 | 3.5 | 2.6 | 31 | A | — |
| Example 2 | 2.2 | 3.0 | 3.1 | 2.5 | 31 | A | Changing spinning speed of Example 1 |
| Example 3 | 2.2 | 2.2 | 2.5 | 2.5 | 31 | A | Comprising titanium oxide in addition to Example 1(1) |
| Example 4 | 2.2 | 2.2 | 2.7 | 2.6 | 31 | A | Comprising thermal stabilizer in addition to Example 1(1) |

TABLE 1-continued

| | Amorphous PEI polymer (Mw/Mn) | Single fiber fineness (dtex) | Shrinkage percentage under dry heat (%) | Tenacity (cN/dtex) | Limiting oxygen index value (LOI) | Fiber forming processability | Remark |
|---|---|---|---|---|---|---|---|
| Example 5 | 2.2 | 2.2 | 3.0 | — | — | — | Fabric (paper) comprising fibers of Example 1 |

Fiber forming processability A: the number of fiber breaking times is 3 times or less/100 kg; B: the number of fiber breaking times is 4 to 7 times/100 kg; C: the number of fiber breaking times is 8 times or more/100 kg.

TABLE 2

| | Amorphous PEI polymer (Mw/Mn) | Single fiber fineness (dtex) | Shrinkage percentage under dry heat (%) | Tenacity (cN/dtex) | Limiting oxygen index value (LOI) | Fiber forming processability*1 | Remark |
|---|---|---|---|---|---|---|---|
| Comparative Example 1 | 2.6 | 6.0 | 6.0 | 2.2 | 30 | B | — |
| Comparative Example 2 | 2.8 | 5.0 | 9.0 | 2.0 | 30 | C | — |
| Comparative Example 3 | 2.6 | 6.0 | 5.5 | 2.4 | 31 | B | Comprising thermal stabilizer in addition to Comparative Example 1(1) |
| Comparative Example 4 | 2.6 | 6.0 | 5.0 | 2.3 | 31 | B | Changing spinning speed of Comparative Example 1(1) |
| Comparative Example 5 | 2.6 | 3.0 | 15.0 | 2.7 | 31 | B | Drawing fibers of Comparative Example 3*2 |
| Comparative Example 6 | 2.6 | 4.0 | 8.0 | 2.6 | 31 | B | Drawing fibers of Comparative Example 3*3 |
| Comparative Example 7 | 2.6 | 3.0 | 13.0 | 2.2 | 31 | B | Heat treating fibers of Comparative Example 5*4 |
| Comparative Example 8 | 2.6 | 6.0 | 5.0 | — | — | — | Fabric (paper) comprising fibers of Comparative Example 4 |

*1Fiber forming processability A: the number of fiber breaking times is 3 times or less/100 kg; B: the number of fiber breaking times is 4 to 7 times/100 kg; C: the number of fiber breaking times is 8 times or more/100 kg.
*2Drawn at a ratio of 2.0 times between rollers set at 150° C.
*3Drawn at a ratio of 1.3 times between rollers set at 150° C.
*4Heat treatment under tension at 200° C. for 5 minutes.

As shown in Table 1, the amorphous PEI fibers obtained in Examples comprising an amorphous PEI polymer having a molecular weight distribution of less than 2.5, and the fibers are excellent in both mechanical property and heat-resisting property, as well as stability during the spinning. Further, the paper comprising such fibers is also found to have a high heat-resisting property. In contrast, as shown in Table 2, when using the amorphous PEI polymers having a molecular weight distribution of 2.5 or more, it is difficult to obtain a fiber having a single fiber fineness of 3.0 dtex or less because of poor spinning stability during the fiber formation process. Therefore, in the case of producing a fiber having a single fiber fineness of 3.0 dtex or less from the amorphous PEI polymers having a molecular weight distribution of 2.5 or more, the spun fiber should be once taken up and followed by drawing to attain a small fineness. However, in the case where fiber was once drawn, the drawn fiber could not combine both mechanical property and heat-resistant property because of the large shrinkage percentage under dry heat. On the contrary, the fibers of the present invention realize both mechanical property and heat-resistant property.

INDUSTRIAL APPLICABILITY

The amorphous PEI fiber of the present invention combines both excellent heat-resisting property and small fineness suitable for producing fabrics such as papers and nonwoven fabric, and the amorphous PEI fiber can be effectively usable in applications, such as industrial material fields, electric and electronic fields, agricultural material fields, apparel fields, optical material fields, and aircraft, automobile, and vessel fields, as well as many applications other than above.

As mentioned above, the preferred embodiments of the present invention are illustrated, but it is to be understood that other embodiments may be included, and that various additions, other changes or deletions may be made, without departing from the spirit or scope of the present invention.

What is claimed is:

1. An amorphous polyetherimide fiber comprising an amorphous polyetherimide polymer having a weight-average molecular weight (Mw) of about 1,000 to about 32,000 and a molecular weight distribution (Mw/Mn) of less than 2.5, and having a shrinkage percentage under dry heat at 200° C. of 5% or less, a single fiber fineness of 3.0 dtex or less, and a tenacity of the fiber at room temperature is 2.0 cN/dtex or greater, wherein the fiber is an undrawn melt spun fiber.

2. A heat resistant fabric comprising the amorphous polyetherimide fiber recited in claim 1.

3. The heat resistant fabric as claimed in claim 2, wherein the fabric has a shrinkage percentage under dry heat at 200° C. of 5.0% or less.

4. The amorphous polyetherimide fiber as claimed in claim 1, wherein the amorphous polyetherimide polymer has a molecular weight distribution (Mw/Mn) of 1.0 to 2.4.

5. The amorphous polyetherimide fiber as claimed in claim 1, wherein the amorphous polyetherimide polymer has a molecular weight distribution (Mw/Mn) of 1.0 to 2.3.

6. The amorphous polyetherimide fiber as claimed in claim 1, wherein said shrinkage percentage is from −1.0% to 4.5%.

7. The amorphous polyetherimide fiber as claimed in claim 1, wherein said shrinkage percentage is from 0% to 4%.

8. The amorphous polyetherimide fiber as claimed in claim 1, wherein said single fiber fineness is from 0.1 to 2.6 dtex.

9. The amorphous polyetherimide fiber as claimed in claim 1, wherein said single fiber fineness is from 0.1 to 2.3 dtex.

10. The amorphous polyetherimide fiber as claimed in claim 1, wherein said tenacity is from 2.3 to 4.0 cN/dtex.

11. The heat resistant fabric as claimed in claim 2, wherein said shrinkage percentage is from −1.0% to 4.5%.

12. The heat resistant fabric as claimed in claim 2, wherein said shrinkage percentage is from 0% to 4%.

13. The amorphous polyetherimide fiber as claimed in claim 1, wherein the amorphous polyetherimide polymer comprises a metallic oxide.

14. The amorphous polyetherimide fiber as claimed in claim 13, wherein the metallic oxide comprises a titanium oxide.

15. The amorphous polyetherimide fiber as claimed in claim 1, wherein the amorphous polyetherimide polymer comprises a thermal stabilizer.

16. The amorphous polyetherimide fiber as claimed in claim 15, wherein the thermal stabilizer comprises at least one member selected from the group consisting of a hindered-phenol-type thermal stabilizer, a phosphorus thermal stabilizer, a lactone-type thermal stabilizer, a hydroxylamine-type thermal stabilizer, a vitamin-E-type thermal stabilizer, and a sulfur thermal stabilizer.

17. The amorphous polyetherimide fiber as claimed in claim 1, wherein the amorphous polyetherimide polymer includes at least one metallic oxide selected from the group consisting of a silicon oxide, a magnesium oxide, an alumina, a zirconium oxide, a titanium oxide, and an iron oxide.

* * * * *